340-690 SR

5/22/79 OR 4,156,236

United States Patent [19]

Conkle

[11] 4,156,236

[45] May 22, 1979

[54] MINE ROOF MOVEMENT MONITOR

[76] Inventor: Ellsworth V. Conkle, P.O. Box 190, Paonia, Colo. 81428

[21] Appl. No.: 876,040

[22] Filed: Feb. 8, 1978

[51] Int. Cl.[2] ..... E21D 21/00; G08B 21/00

[52] U.S. Cl. ..... 340/690; 73/784; 405/259

[58] Field of Search ..... 340/690, 686; 324/52; 200/61.53; 73/784

[56] References Cited

U.S. PATENT DOCUMENTS

| | | | |
|---|---|---|---|
| 3,111,655 | 11/1963 | Kotarsky et al. | 340/690 |
| 3,594,773 | 7/1971 | Conkle et al. | 340/690 |
| 3,646,553 | 2/1972 | Conkle | 73/784 |
| 4,001,942 | 1/1977 | Schuermann et al. | 73/784 X |

*Primary Examiner*—Donald J. Yusko

*Attorney, Agent, or Firm*—Clarence A. O'Brien; Harvey B. Jacobson

[57] ABSTRACT

Movement of the roof of a mine shaft is detected by unlatching of a position sensing device in an elevated position causing it to drop to a lowered position pivotally suspended by a link from a bracket yieldably held in abutment with the roof ceiling. The bracket is positioned on the lower end of an elongated support bolt by a nut acting as a latch releasing member engageable with a latch element connected to the link for latched support of the sensing device in the elevated position.

13 Claims, 8 Drawing Figures

MINE ROOF MOVEMENT MONITOR

BACKGROUND OF THE INVENTION

This invention relates to detection of mine roof movements and is an improvement over the movement monitoring apparatus disclosed in my prior U.S. Pat. No. 3,646,553, issued FEB. 2, 1972.

In the movement detecting apparatus of the type disclosed in my prior U.S. patent referred to, a sensing switch is mounted by a housing on the roof ceiling in operative relation to a switch actuator adjustably positioned on the lower end of the support bolt through which the switch housing is yieldably held in abutment with the roof ceiling. Sensitivity of the detecting apparatus depends, therefore, in large measure, on the mounting and operating characteristics of the sensing switch. Accordingly, the adjustment setting of the switch actuator is not always reliable and changes in sensitivity sometimes occurs even through no adjustment is made. Further, replacement of the sensing switch requires readjustment and is rather difficult without complete disassembly of the apparatus.

It is, therefore, an important object of the present invention to provide an improved movement detecting apparatus of the aforementioned type which includes a sensing switch that does not effect sensitivity adjustment and may be replaced without disturbing such adjustment.

SUMMARY OF THE INVENTION

In accordance with the present invention, a position sensing device is pivotally suspended by a suspension link from a bracket yieldably held in abutment with the roof ceiling of a mine shaft by a nut adjustably secured to the lower end of a support bolt suspended from a bore extending upwardly into the earth from the mine shaft. The nut acts as a latch release member engageable with the end of a latch element which automatically latches to form a rigid support, with the bracket and the link, for the sensing device in its elevated position. Movement of the bracket relative to the support bolt in excess of a preset amount thereby causes the latch element to release. The sensing device then drops to its lowered position rendering an indicator operative such as a reflector or a position sensing switch closing to energize an indicator lamp.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

DETAILED DESCRIPTION OF PREFERRED EMBODIMENTS

Figure 1:
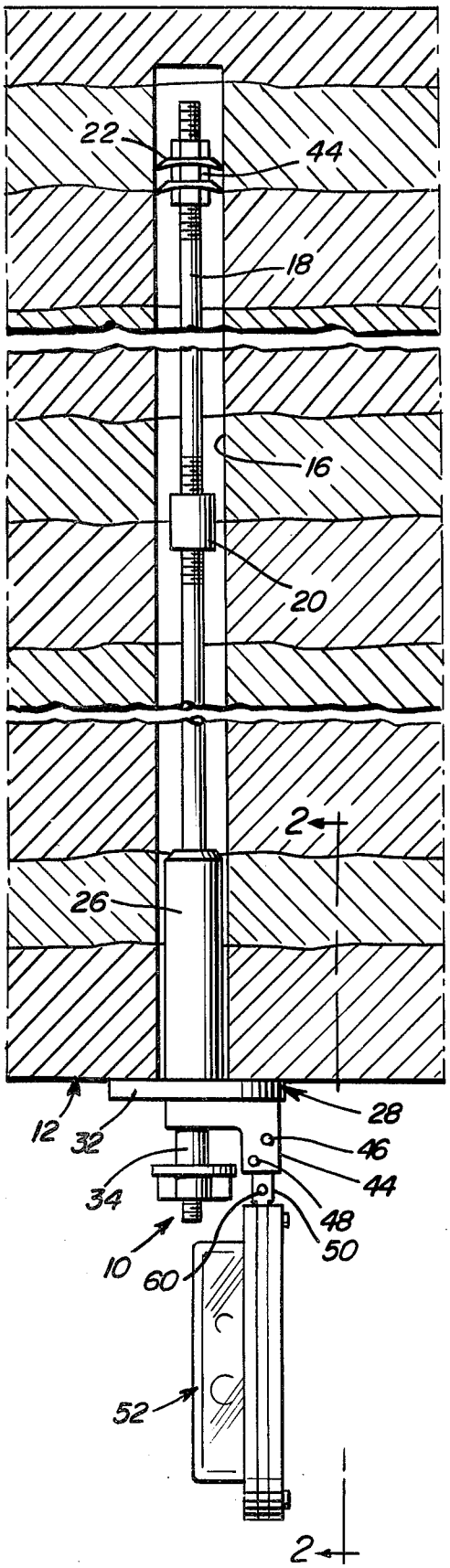
FIG. 1 is a side elevation view of the detecting apparatus of the present invention installed in a mine shaft.

Referring now to the drawings in detail, FIG. 1 illustrates an installation for the mine roof movement monitor of the present invention generally referred to by reference numeral 10. The monitor is shown mounted on the ceiling surface 12 of a generally horizontal mine shaft located below the ground surface 14. The roof of the mine shaft is accordingly formed by a plurality of earth formation strata through which a vertical bore 16 is drilled upwardly from the ceiling surface for insertion therein of an elongated support formed by one or more bolts 18. The support bolts are externally threaded adjacent opposite longitudinal ends and where two or more are utilized, they are interconnected by double threaded coupling nuts 20. The uppermost support bolt 18 has at least two anchor clips 22 sandwiched between anchor nuts 24 threadedly positioned on the support bolt. The anchor clips are bowed in such a direction, as shown, to engage the vertical sides of the bore 16 adjacent its upper end and anchor the support bolt 18 at a location adjacent surface 14 of substantially no roof movement. The lowermost support bolt 18 is connected to the monitor 10, extending through a sleeve 26 connected to the monitor 10.

Figure 5:
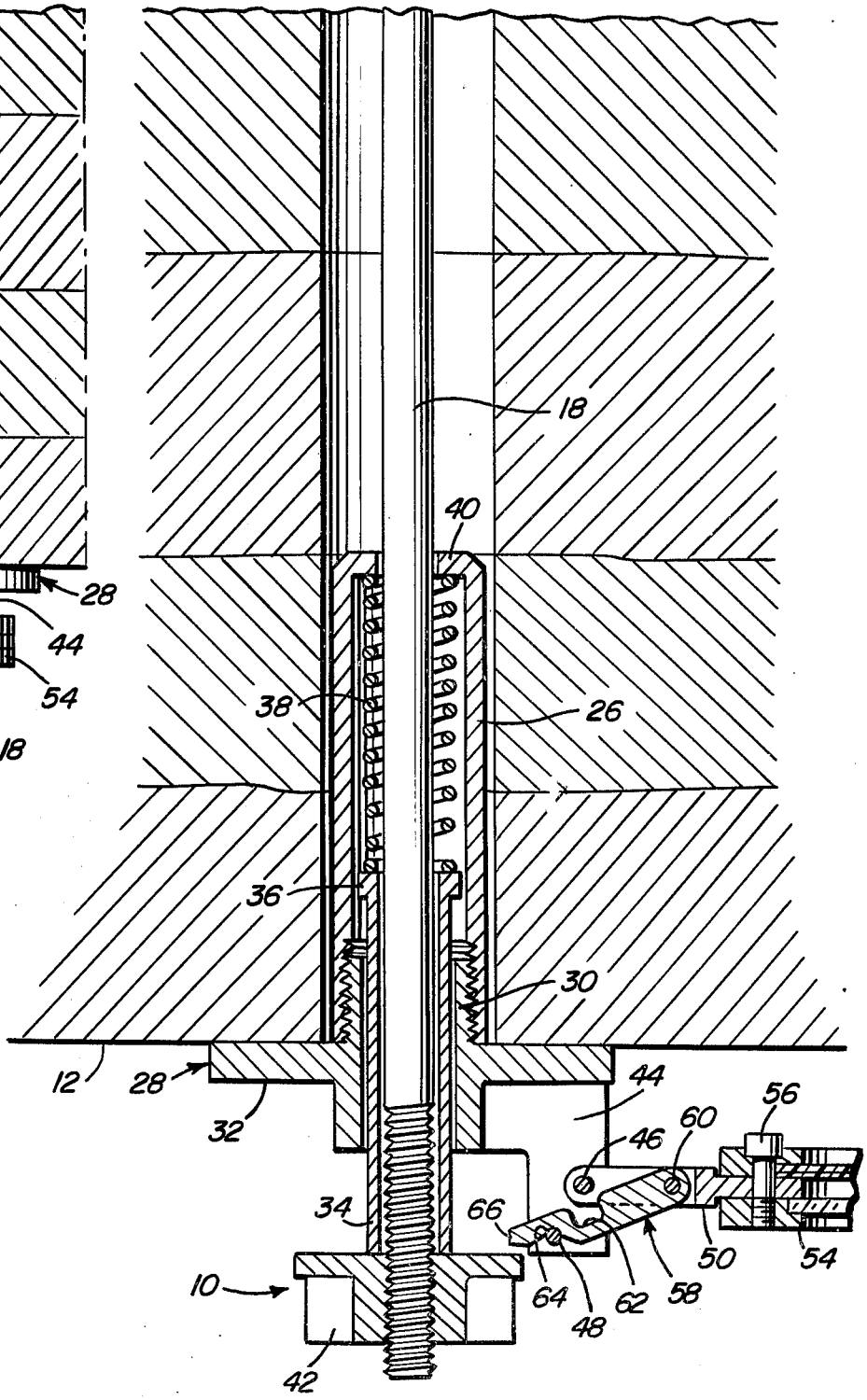
FIG. 5 is an enlarged section view taken substantially through a plane indicated by section line 5—5 in FIG. 4.

As more clearly seen in FIG. 5, the sleeve 26 is internally threaded adjacent its lower end for threaded connection to a mounting bracket of the monitor generally referred to by reference numeral 28. The mounting bracket 28 includes externally threaded connector portion 30 threadedly received within the sleeve 26 and a flange portion 32 abutting the ceiling surface 12 laterally of the bore 16. The threaded portion 30 forms a slide bearing for tubular member 34 having a flange 36 at its upper end. A coil spring 38 reacts between the flange 36 and the upper end wall 40 of the sleeve 26 so as to exert an upward bias on the bracket 28 to which the sleeve is connected by the threaded portion 30. The tubular member 34 at its lower end abuts a nut member 42 threadedly mounted on the lower end of the bolt 18. The axial bias of the spring 38 may be adjusted by rotation of the nut member 42 which also acts as a latch release as will be explained hereinafter.

Figure 2:
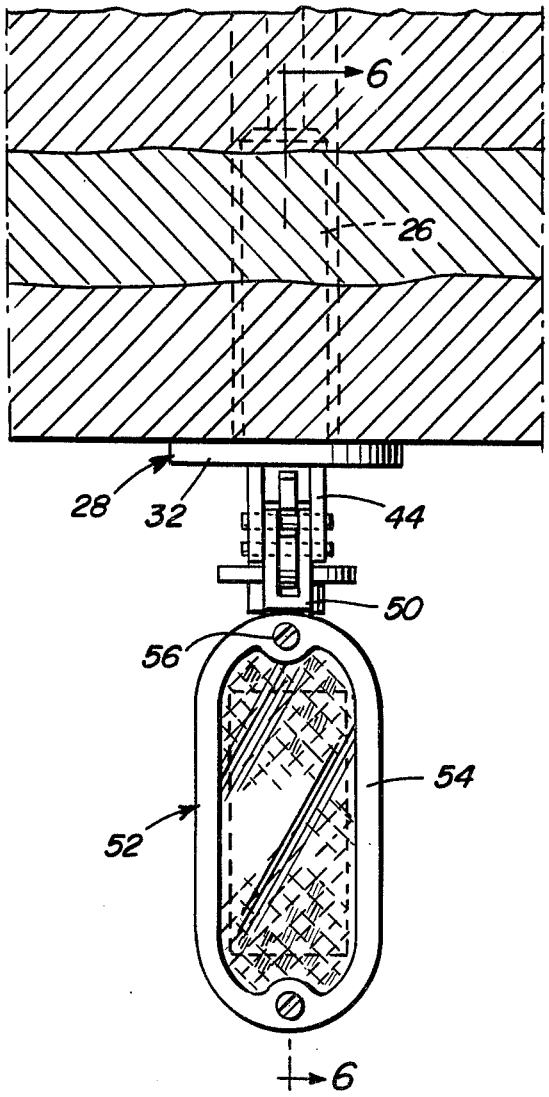
FIG. 2 is an enlarged elevation view of the apparatus as seen from a plane indicated by section line 2—2 in FIG. 1.
Figure 3:
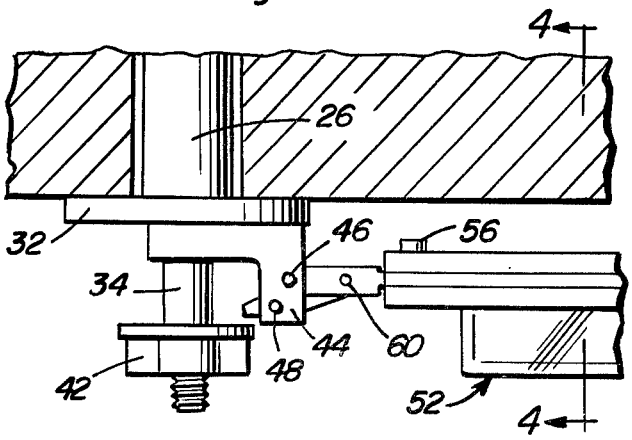
FIG. 3 is an enlarged partial side elevation view of the apparatus shown in a latched or armed condition.
Figure 4:
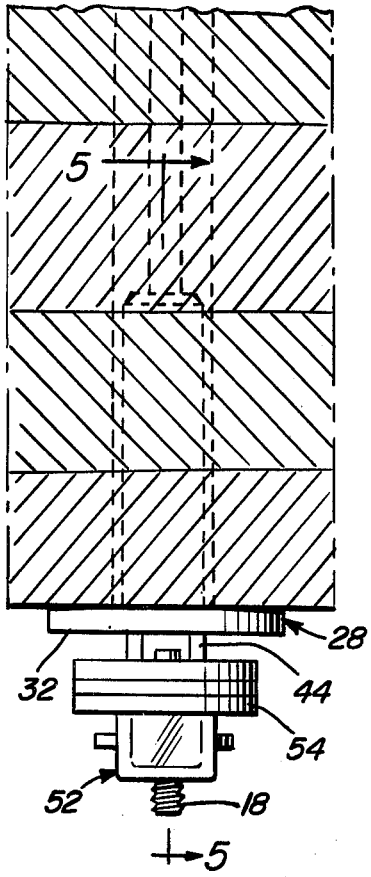
FIG. 4 is an elevation view of the apparatus as seen from a plane indicated by section line 4—4 in FIG. 3.

A pair of parallel spaced arms 44 depend from the bracket flange 32. A pivot shaft 46 is supported between the arms 44 in vertically and laterally spaced relationship to a latch pin 48 which also extends between the arms 44. The pivot shaft establishes a pivotal axis generally parallel to the ceiling surface at the bore opening. A link 50 is pivotally connected to the bracket 28 by the pivot shaft 46 for pivotal support of a position sensing device generally referred to by reference numeral 52. As more clearly seen in FIGS. 2 and 6, the sensing device 52 includes a peripheral frame 54 to which the link 50 is pivotally connected by a pin 56 extending at right angles to the pivot shaft 46. Accordingly, the device 52 may be pivotally displaced in a plane at right angles to its displacement about the pivotal axis of pivot shaft 46. The device 52 is either pivotally suspended in a lowered vertical position as shown in FIGS. 1, 2 and 6 or latched in a horizontal elevated position as shown in FIGS. 3, 4 and 5 by means of a latch element generally referred to by reference numeral 58.

The latch element 58 is pivotally connected by pivot pin 60 to the suspension link 50 between the pivot shaft 46 and pivot pin 56. The latch element is provided with a recess 62 in one longitudinal edge intermediate its opposite longitudinal ends so as to receive the pivot shaft 46 therein in the unlatched condition when the sensing device 52 is suspended in its lowered position as shown in FIG. 6. In the latched condition with the device 52 in its elevated position as shown in FIG. 5, the latch element 58 engages the latch pin 48 in a latch recess 64. The latch element in its latched condition will thus cooperate with the link 50 and bracket 28 to form a rigid triangular support for the sensing device 52 in the elevated position. The latch element is disengaged by an upward force applied to a latch disengaging end 66 projecting from the bracket arms 44, as shown in FIG. 5, which will lift the latch element 58 off the latch pin 48. The weight of the sensing device 52 will then swing it downwardly about the pivot shaft 46 to the lowered position shown in FIG. 6 in which the latch pin 48 abuts the link 50, the latch element 58 being then held generally parallel to the link 50 by abutment of the latch element with the pivot shaft 46 in its recess 62. It will be apparent that the latch pin 48 will then act as a one-way stop to limit clockwise movement of the sensing device 52 as viewed in FIG. 6.

Figure 6:
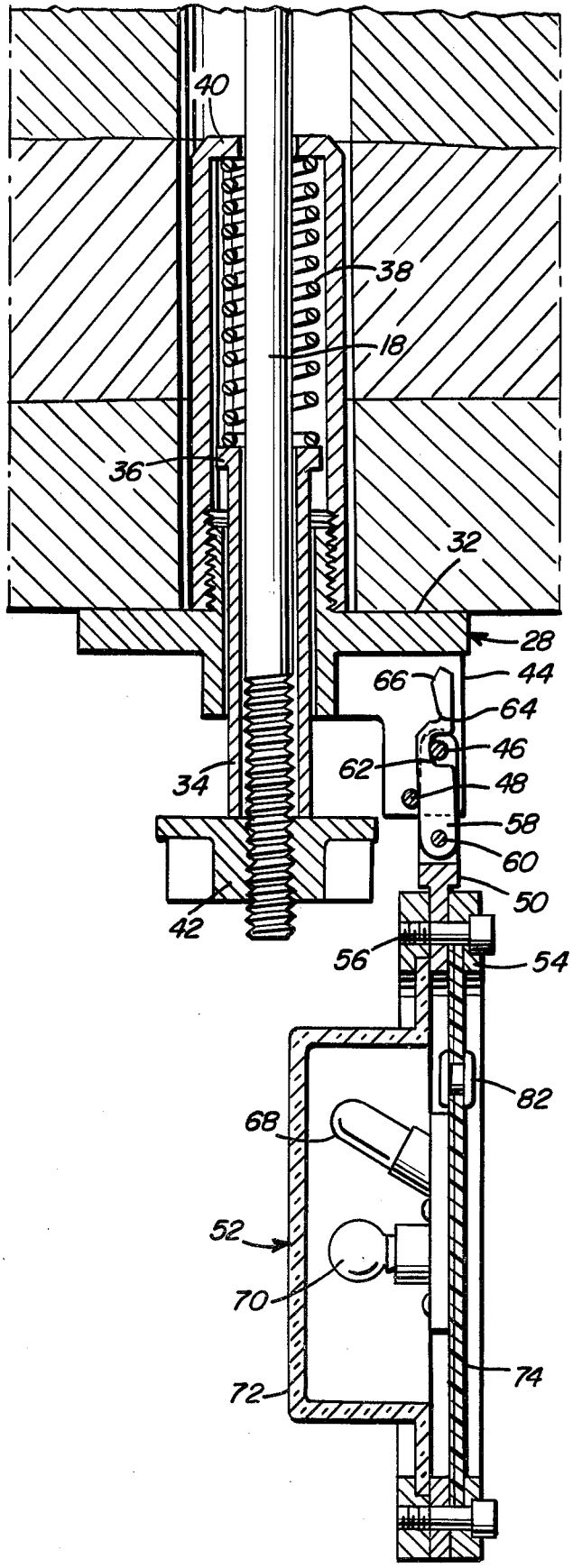
FIG. 6 is an enlarged section view taken substantially through a plane indicated by section line 6—6 in FIG. 2.

In the latched condition of the monitor as shown in FIG. 5, the axial position of the nut member 42 on the lower end of the support bolt 18 is closely spaced from the latch disengaging portion 66 so that a predetermined axial movement of the bracket 28 relative to the support bolt reflecting mine roof movement, will release the latch element causing the sensing device 52 to drop from its elevated position to the lowered position shown in FIG. 6. In the lowered position shown, the contacts of a mercury switch 68 mounted by the sensing device will close and thereby energize an indicator lamp 70 to signify roof movement. The mercury switch 68 and indicator lamp 70 may be enclosed by means of a transparent cover 72 and mounted on a back wall 74 attached to the peripheral frame 54. In the horizontal elevated position of the device 52, the contacts of the mercury sensor switch 68 will be open so that the indicator lamp 70 will be deenergized.

Figure 7:
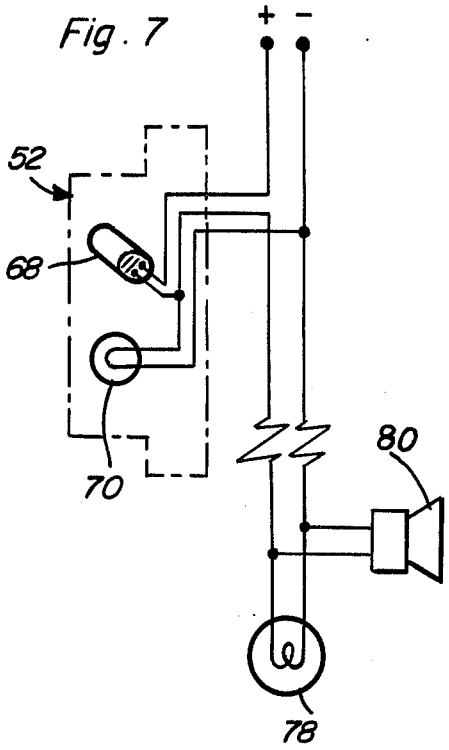
FIG. 7 is a schematic view illustrating the wiring associated with one embodiment of the invention.
Figure 8:
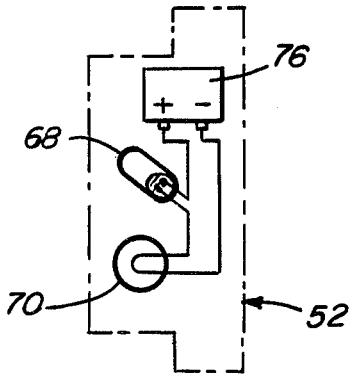
FIG. 8 is a schematic view illustrating the wiring associated with another embodiment of the invention.

In one form of the invention, as shown in FIG. 8, the mercury switch 68 and indicator lamp 70 are connected in series across the terminals of a DC battery 76 mounted within the housing formed by cover 72 and wall 74. In another embodiment of the invention shown in FIG. 7, the mercury switch and indicator lamp are connected in series with a remotely located indicator lamp 78 and audible alerting device 80 to a remotely located source of electrical energy by means of wiring extending through a grommeted opening 82 in the back wall 74 of the housing. As another alternative, the indicator lamp 70, mercury switch 68 and cover 72 may be replaced by a lens covered reflector reflecting light from machinery headlights and miners' headlamps to indicate roof movement.

When initially installing the monitor 10, the nut member 42 is threaded onto the lower end of the support bolt 18 and the sensing device 52 elevated to the horizontal position to cause latch element 58 to become latched. The nut member 42 is then rotated to axially adjust its position on the support bolt until it engages the end 66 of the latch element causing it to release. The nut member 42 may then be backed off by a certain amount to provide the desired sensitivity for the monitor. The sensing device 52 is then relatched in its elevated position and will be armed for detecting any roof movement causing displacement of bracket 28 relative to the support bolt 18 in excess of a preset amount.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with an elongated support anchored to the roof of a mine shaft and having a lower end portion projecting into the mine shaft through an opening in the roof ceiling, a monitor assembly mounted on said lower end portion of the support for detecting displacement of the roof, comprising a bracket positioned on said support, a position sensing device pivotally suspended from the bracket for gravitational displacement from an elevated position to a lowered position, latch means for holding the position sensing device in the elevated position, and means fixed to the lower end portion of the support for releasing the latch means in response to displacement of the bracket relative to the support.

2. The combination of claim 1 including indicator means connected to the sensing device and rendered operative thereby in the lowered position for signifying displacement of the roof.

3. The combination of claim 2 wherein said latch releasing means comprises a latch engaging member adjustably secured to the support, and spring means engageable with said member for yieldably holding the bracket in abutment with said roof ceiling.

4. The combination of claim 3 wherein said position sensing device includes a frame, a suspension link connected to said frame, pivot means connecting the link to the bracket for pivotal displacement of the frame about an axis substantially parallel to said roof ceiling at the opening therein, and position responsive switch means carried on the frame to which the indicator means is connected.

5. The combination of claim 4 wherein said latch means includes an elongated latch element pivotally connected to the suspension link and a latch pin mounted on the bracket and engageable with the latch element, said latch element having a pair of recesses formed therein respectively receiving the latch pin in a latched condition and the pivot means in the lowered position of the sensing device, said link and latch element forming a triangular relationship with the bracket in the latched condition to support the sensing device in the elevated position, said latch pin abutting the link in the lowered position of the sensing device to act as a one-way stop.

6. The combination of claim 1 wherein said position sensing device includes a frame, a suspension link connected to said frame, pivot means connecting the link to the bracket for pivotal displacement of the frame about an axis substantially prallel to said roof ceiling at the opening therein, and position responsive switch means carried on the frame to which the indicator means is connected.

7. The combination of claim 6 wherein said latch means includes an elongated latch element pivotally connected to the suspension link and a latch pin mounted on the bracket an engageable with the latch element, said latch element having a pair of recesses formed therein respectively receiving the latch pin in a latched condition and the pivot means in the lowered position of the sensing device, said link and latch element forming a triangular relationship with the bracket in the latched condition to support the sensing device in the elevated position, said latch pin abutting the link in the lowered position of the sensing device to act as a one-way stop.

8. The combination of claim 1 wherein said latch releasing means comprises a latch engaging member adjustably secured to the support, and spring means engageable with said member for yieldably holding the bracket in abutment with said roof ceiling.

9. In combination with an elongated support anchored to the roof of a mine shaft and having a lower end portion projecting into the mine shaft through an opening in the roof ceiling, a monitor assembly mounted on said lower end portion of the support for detecting displacement of the roof, comprising a bracket positioned on said support, a position sensing device, a suspension link pivotally connecting the sensing device to the bracket, latch means connected to the link and engageable with the bracket for holding the sensing device in an elevated position, release means fixed to the lower end portion of the support for releasing the latch means in response to displacement of the bracket relative to the support to permit lowering of he sensing device to a suspended position, and biasing means engageable with the release means for yieldably holding the bracket in abutment with the roof ceiling.

10. The combination of claim 9 wherein said latch means includes an elongated latch element pivotally connected to the suspension link and a latch pin mounted on the bracket and engageable with the latch element, said latch element having a pair of recesses formed therein respectively receiving the latch pin in a latched condition and the pivot means in the suspended position of the sensing device, said link and latch element forming a triangular relationship with the bracket in the latched condition to support the sensing device in the elevated position, said latch pin abutting the link in the suspended position of the sensing device to act as a one-way stop.

11. The combination of claim 10 including indicator means connected to the sensing device and rendered operative thereby in the suspended position of signifying displacement of the roof.

12. The combination of claim 11 wherein said release means comprises a latch engaging member adjustably secured to the support, and spring means engageable with said member for yieldably holding the bracket in abutment with said roof ceiling.

13. The combination of claim 10 wherein said release means comprises a latch engaging member adjustably secured to the support, and spring means engageable with said member for yieldably holding the bracket in abutment with said roof ceiling.

* * * * *